United States Patent [19]

Jacobson

[11] Patent Number: 4,509,926

[45] Date of Patent: Apr. 9, 1985

[54] SUPER VENTILATOR JET SKI ENGINE HOOD (BOAT)

[76] Inventor: Clayton J. Jacobson, Box 5338, Parker, Ariz. 85344

[21] Appl. No.: 352,084

[22] Filed: Feb. 25, 1982

[51] Int. Cl.[3] ..... B63B 17/00

[52] U.S. Cl. ..... 440/89; 440/77; 114/361; 114/211

[58] Field of Search ..... 440/77, 88, 89; 114/270, 361, 211, 177; 180/69 R, 54 A

[56] References Cited

U.S. PATENT DOCUMENTS 2,390,218 12/1945 Lamb et al. ..... 180/54 A 3,826,220 7/1974 Jacobson ..... 144/270

*Primary Examiner*—Trygve M. Blix

*Assistant Examiner*—Thomas J. Brahan

[57] ABSTRACT

An improved engine hood for jet ski type vehicles (boats). Air flow is greater and less water finds it's way into the engine compartment because of large ducts peripherally located, up and down in a horizontal plane around the interior of the hood, the down sections are water traps which drain outside and the previously horizontal ducts become snorkel type loops when the boat is capsized. The hood is removable and floats. The hood is characterized by a large rearwardly and forwardly louvered opening on the top, and a flexible exhaust conduit which appends the bottom extending down into the engine compartment.

1 Claim, 5 Drawing Figures

Fig.1
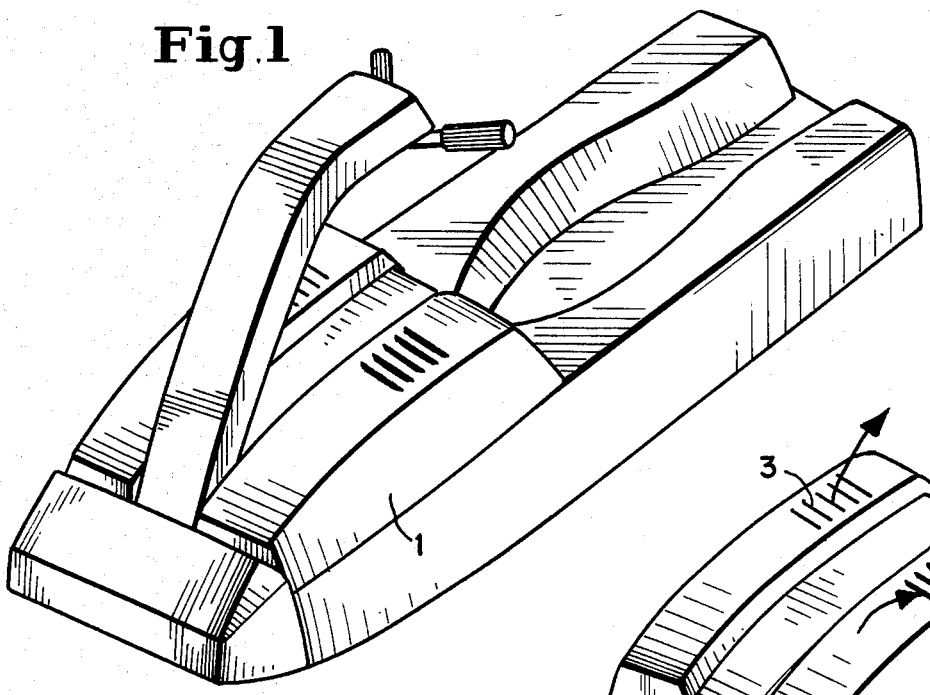
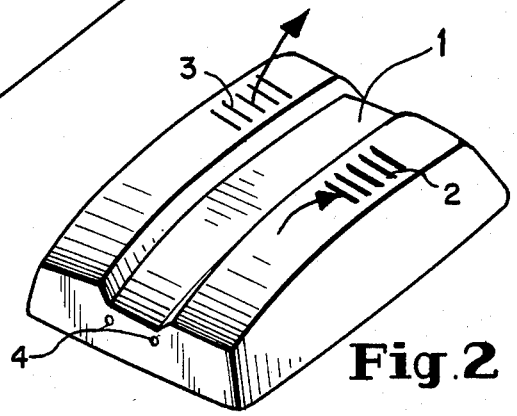
Fig.2
Fig.3
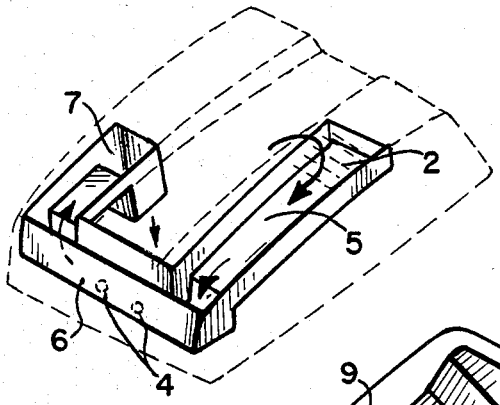
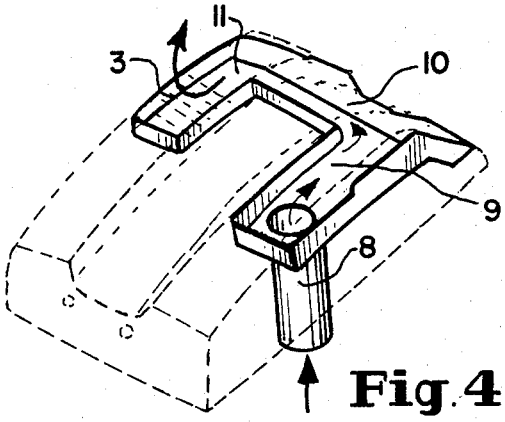
Fig.4
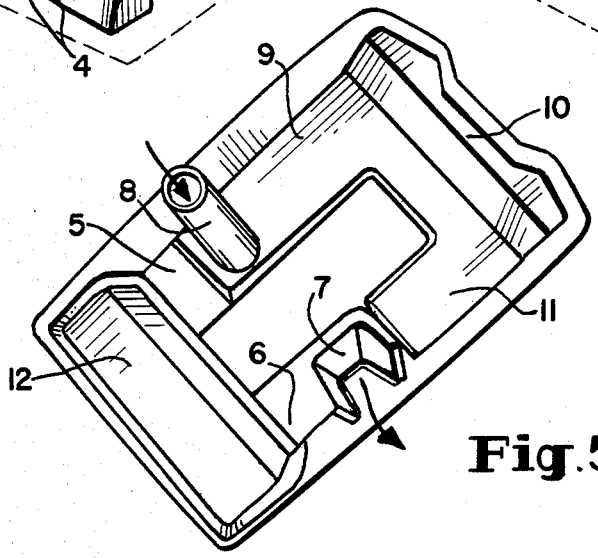
Fig.5

SUPER VENTILATOR JET SKI ENGINE HOOD (BOAT)

CROSS REFERENCES

Jacobson Pat. No. 3,369,518;
Jacobson Pat. No. 3,623,447;
Jacobson Pat. No. 3,826,220.

BACKGROUND

Inspection of the patents listed as cross references will introduce you to the Jet Ski type vehicles to which this invention relates. It is a small boat operated primarily in the standing position, narrow like a ski and powered by a jet of water from the rear. Many times control or balance is lost and the vehicle is overturned and otherwise very indiscriminately thrown upon the water. In the prior art a "U" shaped duct was inverted with the openings located near the center of mass, this provided ventilation and worked very well when the vehicle was upright. The "U" however became horizontal when the jet ski was held on it's side, this was not desireable and the situation was further worsen when Coast Guard regulations required addition of a forward facing air scoop into this system. Under certain condition the water would force into this air scoop, pass unrestricted directly into the engine compartment.

The present invention cures these faults with an improved method of circumferential ducting, locating the inlet and outlets at the top rear of the engine hood and providing water traps with small drains located in the ducts themselves. Thus if the craft is held on its side in the water the previously horizontal circumferential ducts now become vertical "U" shapes limiting the water access. Upon righting the water taken in, runs to the traps and is drained to the exterior of the boat.

SUMMARY OF THE INVENTION

The objects of this invention were to provide a safer conformation of the hood configuration, this was accomplished by the utilization of a overall flatter surface with recessed louver type openings which could provide greater flow without a sharp protrusion such as a scoop, in the same manner the improved location and shape of these inlets and outlets greatly reduced the amount of water ingestion. A further object of this invention was to provide ducts of greater capacity and free of resistance with less water intrusion, enabled by the horizontal circumferential ducts with water traps. A further object of this invention was to provide this hood, which is removeable, to float if set inadvertly upon the water, this unique shape and ducting, floats when placed inverted on the water and to insure further against accidental or indiscriminate placement, a floatation chamber has been provided, integral with the ducting system. A further object was to be able to set the hood down flush on the dock without damage, this has been accomplished by utilizing flexible conduits where their lengths exceeded the plane of the bottom of the hood. These have all been substantial improvements over the prior art.

BRIEF DESCRIPTION OF THE DRAWINGS

FIG. 1 is a perspective view of a jet ski boat shown in the operating position with the engine hood in place.

FIG. 2 is a perspective view of the engine hood separated from the vehicle.

FIG. 3 is a perspective view of the interior air ducting intake system, shown inside ghost of FIG. 2.

FIG. 4 is a perspective view of the interior air ducting exhaust system, shown inside ghost of FIG. 2.

FIG. 5 is a bottom plan view.

DESCRIPTION OF THE PREFERRED EMBODIMENTS

The SUPER VENTILATOR JET SKI ENGINE HOOD (boat) is a light weight plastic engine cover which provides a means to protect internal combustion engines from water ingestion in jet ski type vehicles while providing adequate air intake and exhaust flow. FIG. 1, 1 shows the hood in place on a jet ski, the hood is characterized by a multiple set of upwardly open louvers or ventilation openings. These louvers are shown in FIG. 2. Louvers 2 are forwardly faced for air induction and louvers 3 are rearwardly faced for exhaust. These due to their multiple and small protrusions provide a maximum capacity and minimum risk of injury to the operator. The location of these at the top and rear has proven to give dramatically drier operation, the intake louvers 2 direct the air flow into the intake air ducting shown in FIG. 3. The air and any accompanying water travel thru a generally horizontal peripheral duct structure 5 into water collection cavity (trap) 6 the water drains to the exterior from drains 4 and the air continues thru duct 7 into the interior of the vehicle. The most dangerous condition for water ingestion is when the operator falls from the vehicle but does not release his hold on the handles. Jet ski boats are self righting but when held forcefully by the operator on their side this system gives protection due to the configuration of these ducting channels, which rise to the high side of the boat held in such a manner. The exhaust air ducting system shown in FIG. 4 enjoys the same general characteristics, the air flows up flexible asperation conduit 8 thru a generally horizontal peripheral duct structure 9 into the water collection cavity (trap) area 10 (equipped with drains not shown), up channel 11 to rearwardly facing louvers 3 and out into the open atmosphere. The flexible conduit 8 protrudes from the open bottom of the hood, to extend into the lower portion of the engine compartment so that gasoline fumes which are heavier than clean air, which tend to stay in the lower parts of the engine compartment are the first to be evacuated. The conduit thus protuding as shown in FIGS. 4 & 5 is vulnerable to damage in handling if not of a flexible nature. FIG. 5 illustrates the open bottom of the hood with all the component parts in place including flotation compartment 12. These interior pieces are easily formed by vacuum forming plastic or fibre glass. The hood thusly constructed enables large ducts to be fitted perimetrically or circumferentially up and down in a horizontal plane around the interior of the hood, effectively separating the water from the air and providing such a quantity of air to use for engine cooling if desired. When the vehicle is in a capsized position the previously horizontal air ducts now enjoy a snorkel type position and upon righting the water taken in is collected in the water traps 6 & 10 and drained harmlessly outside.

I claim:

1. In a waterborne vehicle provided with a upwardly open engine compartment and a releasable hood characterized by a forward edge and lateral sides and dimensioned to form an upper closure for said engine compartment the improvement comprising;

a generally horizontal peripheral duct structure formed on the interior of said hood, characterized by lower collection cavities (traps) communicating with lateral raised aspiration cavities along the sides of said hood, said collection cavities being deployed at a lower level that said aspiration cavaties to collect water therefrom in the course of operation of said vehicle, each collection cavity in conjunction with the aspiration cavities transverse the hood structure and terminate on the opposite side of said hood;

drainage openings formed in said collection cavities for draining water collected therein;

ventilation openings formed in said hood in alignment over said lateral cavities;

an aspiration conduit connected to communicate with said lateral cavaties and said engine compartment.

* * * * *